US008341905B2

(12) United States Patent
Macchiaverna et al.

(10) Patent No.: US 8,341,905 B2
(45) Date of Patent: Jan. 1, 2013

(54) POSITIONING PLATE FOR FOUNDATION ANCHOR BOLT

(76) Inventors: Ken Macchiaverna, Seaside Park, NJ (US); Salvatore Anello, Harleysville, PA (US)

( * ) Notice: Subject to any disclaimer, the term of this patent is extended or adjusted under 35 U.S.C. 154(b) by 418 days.

(21) Appl. No.: 12/590,207

(22) Filed: Nov. 4, 2009

(65) Prior Publication Data

US 2010/0107547 A1 May 6, 2010

Related U.S. Application Data

(60) Provisional application No. 61/198,395, filed on Nov. 6, 2008.

(51) Int. Cl.
*E02D 27/00* (2006.01)

(52) U.S. Cl. ..... 52/295; 52/698; 52/707

(58) Field of Classification Search ..... 52/23, 105, 52/283, 293.2, 293.3, 295, 698, 701, 706, 52/707, 712–715; 411/107, 400; 405/302.1
See application file for complete search history.

(56) References Cited

U.S. PATENT DOCUMENTS 2,625,815 A * 1/1953 Black ..... 52/126.1
4,389,830 A * 6/1983 Ingeberg ..... 52/710
5,050,364 A * 9/1991 Johnson et al. ..... 52/705
6,138,421 A * 10/2000 Grigsby ..... 52/293.2

* cited by examiner

*Primary Examiner* — William Gilbert
*Assistant Examiner* — Patrick Maestri
(74) *Attorney, Agent, or Firm* — Clifford G. Frayne

(57) ABSTRACT

A support plate positioned on or within a construction block formed on the upper surface thereof a channel for the receipt and engagement of a short leg of an anchor bolt, there being two planar vertical upstanding panels adjacent the channel, said vertical upstanding panels engaging the outer circumference of the long leg of the anchor bolt in 180 degree relationship, thereby insuring its maintenance in a vertical orientation.

8 Claims, 4 Drawing Sheets

POSITIONING PLATE FOR FOUNDATION ANCHOR BOLT

RELATED APPLICATIONS

Applicant claims the benefit of provisional application Ser. No. 61/198,395, filed Nov. 6, 2008.

BACKGROUND OF THE INVENTION

1. Field of the Invention

The present invention relates generally to building construction, and more specifically, to a positioning plate cooperative with a foundation anchor bolt to allow contractors to quickly and accurately position and secure anchor bolts within the masonry construction block foundation in order to secure sill plates to the anchor bolts and hence the foundation.

2. Description of the Prior Art

Concrete blocks are used in the construction of foundations for both residences and commercial buildings. The blocks are constructed of two side walls, and two end walls, with a mid wall bisecting the block forming two hollow cores which extend in a vertical orientation when the concrete blocks are properly stacked.

The concrete blocks themselves are positioned on a base or footing and extend upwardly in rows, each successive row and each successive block being secured by mortar or cement, the blocks themselves being staggered over the two blocks immediately below.

The height of the foundation wall formed by the blocks may vary depending on whether or not the building is having a full basement or only a crawl space. Nevertheless, in all instances, the upper row of blocks must accommodate a sill plate, in the form of two by six wolmanized or treated wooden boards, or two by eight wooden boards, which are laid flat and which must be tied onto the foundation walls. This is accomplished through the use of anchor bolts which are secured into the hollow cores of the uppermost row of blocks by means of mortar or cement. The anchor bolt is generally L-shaped, having a short leg which forms its base with the long leg extending upwardly, out of the concrete, of sufficient length to pass through an aperture in the sill plate, this long leg of the anchor bolt being threaded at its end for receipt of a nut, thus securing the sill plate to the foundation.

Anchor bolts are required at the corners of any foundation on each side of any opening (access doors, windows) and are spaced pursuant to construction codes every several feet along a straight run of a foundation wall. Further, construction codes may allow for the anchor bolt to be secured in the uppermost row of the foundation wall, or more rigorous construction codes may require that the anchor bolt extend upwardly through two or more rows or layers of blocks.

Since the upper end of the anchor bolt is designed to pass through an aperture in a sill plate and be secured by a nut, and since there are multiple anchor bolts in spaced apart relationship for any one sill plate, if the anchor bolt is not properly positioned within the foundation wall, misalignment with the sill plate will occur, thus delaying construction and increasing the cost of labor.

Another problem associated with the prior art in the positioning of the anchor bolt was the filling of the core of the construction block. The core of the uppermost block on the top row may be in alignment with the core of blocks below it. Thus before positioning the anchor bolt, fill material of some sort must be positioned in this void defined by the cores of the construction block in order to provide support for the anchor bolt when positioned. Oftentimes scrap material, block pieces or other debris is pressed into these cores in an effort to provide a support base. This solution is haphazard at best. The contractor when positioning and securing the sill plate would often strike the anchor bolt with a hammer to determine its stableness. If the underlying support material was insufficient, then the anchor bolt would move, be displaced, or sink into the lower part of the wall and be unavailable for use in securing the sill plate.

Therefore there has been a need for a method and/or apparatus which allows for the accurate positioning of an anchor bolt in a foundation wall, which insures that the upwardly extending leg of the anchor bolt will be in a true orientation so that multiple anchor bolts can accurately engage and cooperate with a sill plate overlaid the upper foundation wall surface. Most importantly the bolt can no longer sink either because of gravity versus wet cement during bolt installation or when tested for strength with hammer by carpenter when installing the sill plate into the lower rows of block because the plate is beneath it.

OBJECTS OF THE INVENTION

An object of the present invention is to provide for an apparatus for the accurate positioning and vertical orientation of an anchor bolt in a foundation wall.

Another object of the present invention is to provide for a novel apparatus and method in which the anchor bolt can be positioned and secured within a foundation wall prior to the anchor bolt being encapsulated with mortar or concrete.

A still further object of the present invention is to provide for a novel apparatus and method which insures the positioning and orientation of multiple anchor bolts on a foundation wall such that alignment with the apertures of a sill plate is assured.

A still further object of the present invention is the prevention of the bolt sinking when aligned over filled lower cores.

A still further object of the present invention is to provide for a novel apparatus and method which allows for the positioning and securing of anchor bolts as are commonly used in the trade without the requirement of any modification to the anchor bolts.

SUMMARY OF THE INVENTION

A support plate positioned on or within a construction block formed on the upper surface thereof a channel for the receipt and engagement of a short leg of an anchor bolt, there being two planar vertical upstanding panels adjacent the channel, said vertical upstanding panels engaging the outer circumference of the long leg of the anchor bolt in 180 degree relationship, thereby insuring its maintenance in a vertical orientation.

BRIEF DESCRIPTION OF THE DRAWINGS

These and other objects of the present invention will become apparent, particularly when taken in light of the following illustrations wherein.

DETAILED DESCRIPTION OF THE INVENTION

Figure 2:
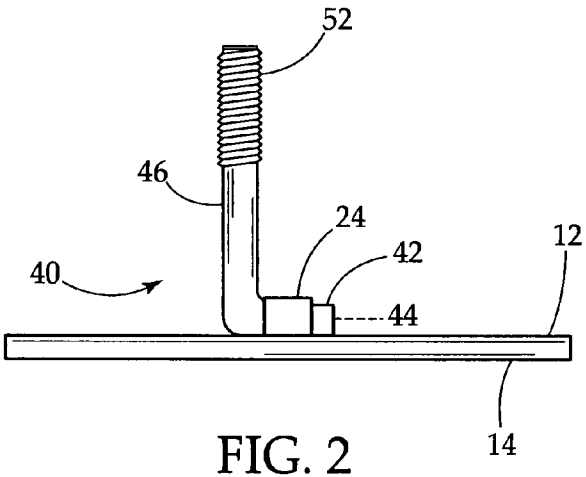
FIG. 2 is a side view of the support plate of the present invention with L-shaped anchor bolt.
Figure 3:
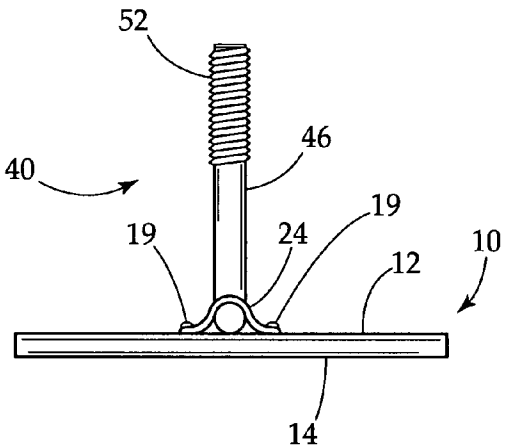
FIG. 3 is a front view of the support plate of the present invention with L-shaped anchor bolt.
Figure 1:
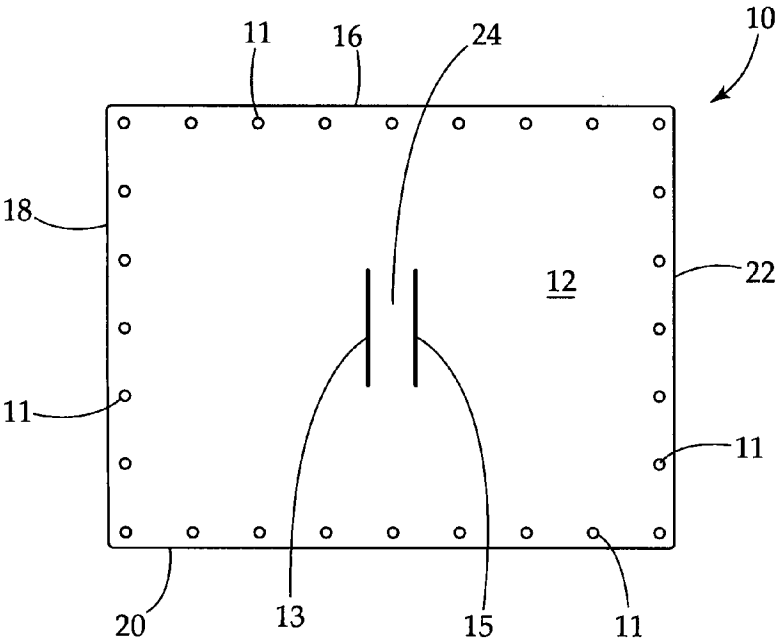
FIG. 1 is a top view of the support plate of the present invention.

FIG. 1 is a top view of the support plate of the present invention, FIG. 2 is a side view of the support plate of the present invention with an anchor bolt, and FIG. 3 is a front view of the support plate of the present invention with an anchor bolt. Support plate 10 is generally rectangular in shape having an upper surface 12, a lower surface 14, and four peripheral edges 16, 18, 20, and 22. The dimensions of the support plate are such that when positioned between an upper and lower foundation block, opposing lateral edges will be sandwiched between the lower surface and upper surface of the respective blocks as more fully illustrated and discussed hereafter.

The upper surface 12 of support plate 10 is formed with a channel member or clip 24 which is preferably arcuate and dimensioned to slidably receive the short leg 42 of anchor bolt 40. An anchor bolt 40 whose short leg 42 has been slidably inserted through channel member or clip 24 is thus secured to the support plate 10.

Channel member or clip 24 is preferably formed by two parallel cuts 13 and 15 in support plate 10, the support plate 10 then being subjected to heat and a die punch in order to form that portion of support plate 10 between the cuts 13 and 15 into the channel member or clip 24. Alternatively, channel member or clip 24 may be formed separately from support plate 10 and secured thereto by spot welds 19 or the like.

Figure 9:
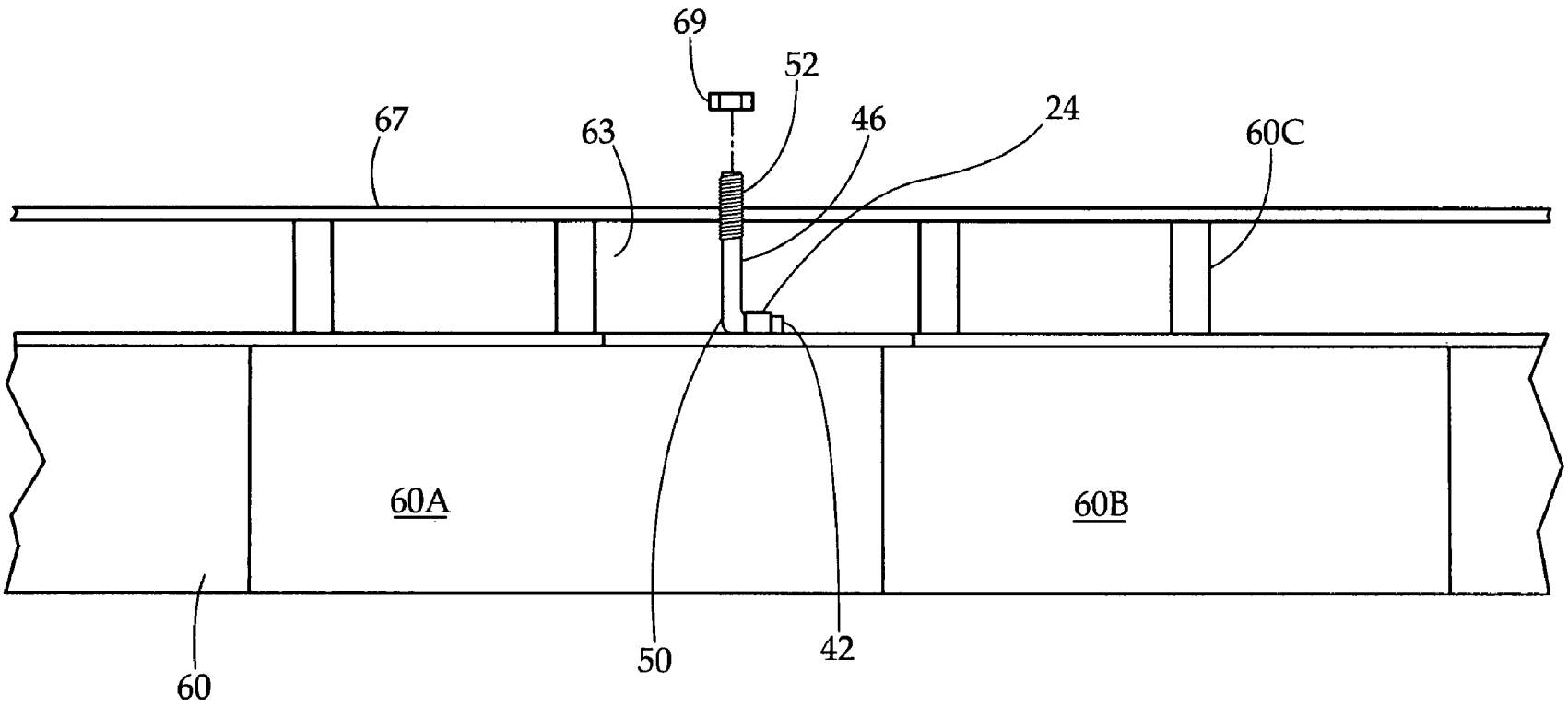
FIG. 9 is a cross-sectional side view of the support plate of the present invention with the anchor bolt secured thereto positioned between foundation blocks.

In the preferred embodiment, anchor bolt 40 would be secured to support plate 10 by means of channel member or clip as illustrated in FIGS. 2 and 3, and positioned as indicated in FIG. 9 within the core 63 of a foundation block. Mortar or the like would then immediately be poured into core 63 so as to cover the channel member or clip 24, the short leg 42 of anchor bolt 40 and a portion of the longer leg 46, thus maintaining the anchor bolt in a substantially vertical position for receipt of a sill plate 67.

In some instances, the mortar may be unavailable to fill the core 63 after the anchor bolt has been so positioned. If the channel member or clip 24 is formed properly, the frictional engagement with the short leg 42 of anchor bolt 40 will be sufficient to maintain the anchor bolt in a vertical orientation until mortar is available.

Figure 5:
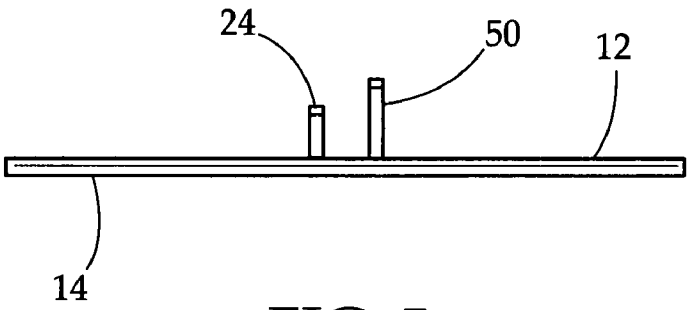
FIG. 5 is a side view of a second embodiment of the support plate of the present invention.
Figure 6:
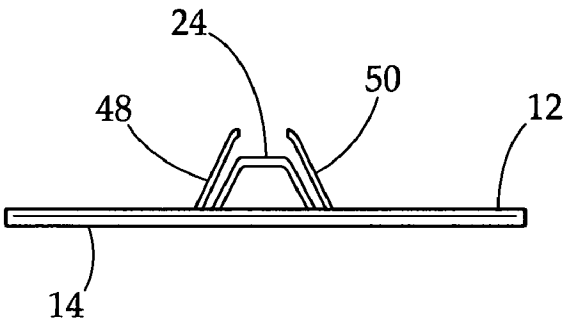
FIG. 6 is a front view of a second embodiment of the support plate of the present invention.
Figure 4:
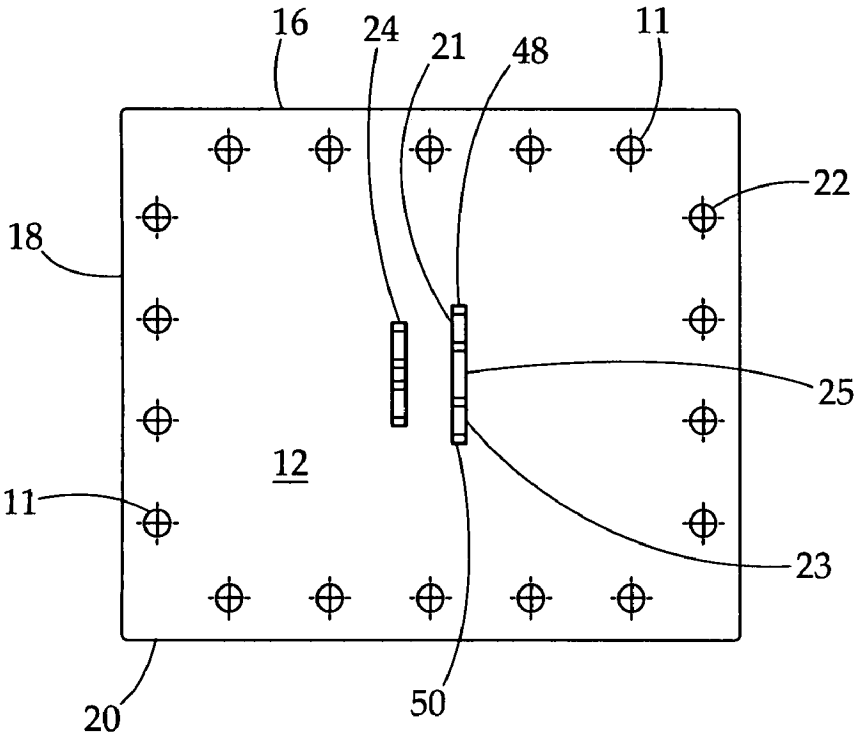
FIG. 4 is a top view of a second embodiment of the anchor plate of the present invention.

In some instances the anchor bolt may rotate about the horizontal axis 44 of short leg 42, and thus the long leg 46 of the anchor bolt 40 may not be oriented in a vertical position. Support plate 10 may therefore be formed with two leg or rotation stops 48 and 50 which engage the long leg 46 of anchor bolt 40 at its lower end (see FIGS. 4, 5, and 6). The engagement of opposing sides of the lower end of anchor bolt 40 by leg or rotation stops 48 and 50 prohibits the anchor bolt 40 from twisting or rotating within channel member or clip 24 and insures that the longer leg 46 of anchor bolt 40 and its threaded upper end 52 are positioned in a vertical orientation. Thus anchor bolt 40 is secured to support plate 10 and insured a vertical orientation by leg or rotation stops 48 and 50 and support plate 10 is secured between an upper and lower block until mortar is applied. Stops 48 and 50 are preferably formed from support plate 10 by parallel cuts 21 and 23 and cross cut and then punched to their angular position as shown. However, they may be spot welded to support plate 10.

Figure 7:
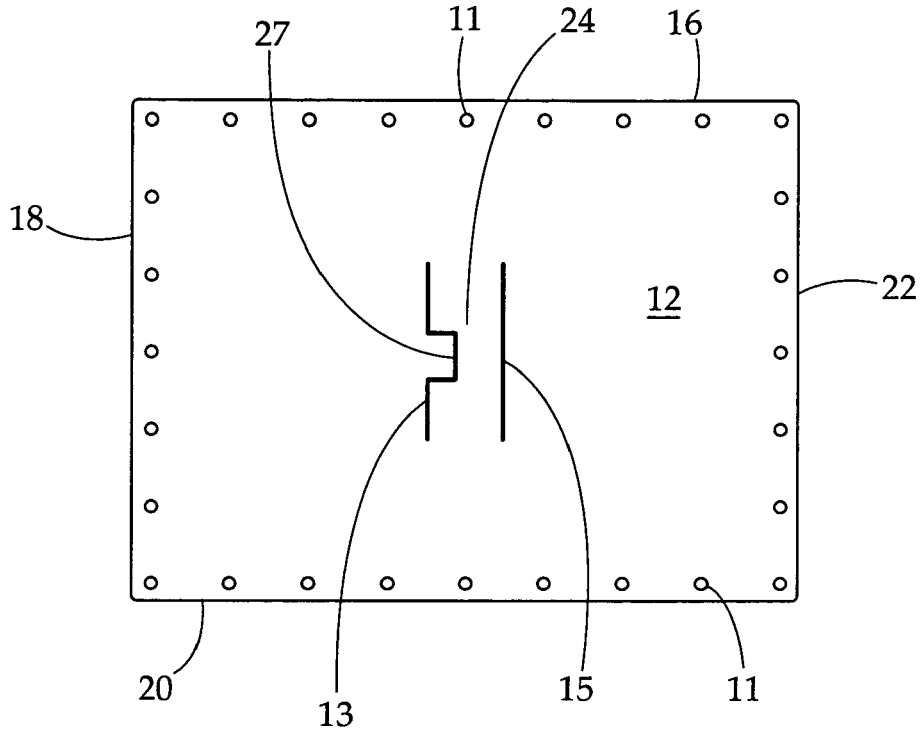
FIG. 7 is a top view of an alternative stop member for preventing rotation of an anchor bolt.
Figure 8:
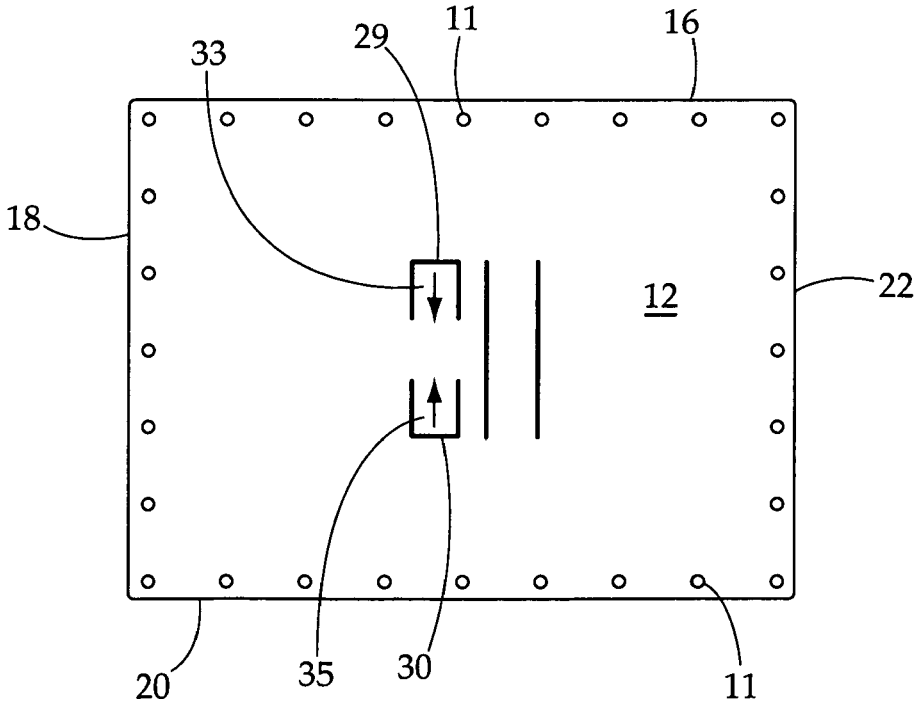
FIG. 8 is a top view of a third embodiment of a stop member for preventing rotation of an anchor bolt.

An alternative method of securing the vertical orientation of anchor bolt 40 may also be achieved by a notch cut 27 in channel member or clip 24 along cut edge 13 which would partially surround the circumference of long leg 46 of anchor bolt 40 (See FIG. 7). Alternatively, generally U-shaped opposing cuts 29 and 31 could be made in support plate 10 as illustrated in FIG. 8, forming two tabs 33 and 35 which could be bent upwardly and towards each other as illustrated in FIG. 8 to form two upstanding stops engageable with opposing sides of the long leg 46 of anchor bolt 40 to prevent any such rotation.

Channel member or clip 24 and leg or rotation stops 48 and could be formed or positioned on the upper surface 12 of support plate 10 at any location of choice, but preferably they would be centrally located so that the upper threaded end 52 of anchor bolt 40 would extend upwardly in a uniform location and orientation as multiple anchor bolts would be used to secure a sill plate.

FIG. 9 is a cross-sectional side view of support plate 10 with anchor bolt 40 positioned thereon, being positioned between foundation blocks. The foundation blocks 60 are secured to a footing by mortar or cement. They are positioned in rows atop from support plate 10 by parallel cuts 21 and 23 and cross cut and then punched to their angular position as shown. However, they may be spot welded to support plate 10.

An alternative method of securing the vertical orientation of anchor bolt 40 may also be achieved by a notch cut 27 in channel member or clip 24 along cut edge 13 which would partially surround the circumference of long leg 46 of anchor bolt 40 (See FIG. 7). Alternatively, generally U-shaped opposing cuts 29 and 30 could be made in support plate 10 as illustrated in FIG. 8, forming two tabs 33 and 35 which could be bent upwardly and towards each other as illustrated in FIG. 8 to form two upstanding stops engageable with opposing sides of the long leg 46 of anchor bolt 40 to prevent any such rotation.

Channel member or clip 24 and leg or rotation stops 48 and could be formed or positioned on the upper surface 12 of support plate 10 at any location of choice, but preferably they would be centrally located so that the upper threaded end 52 of anchor bolt 40 would extend upwardly in a uniform location and orientation as multiple anchor bolts would be used to secure a sill plate.

FIG. 9 is a cross-sectional side view of support plate 10 with anchor bolt 40 positioned thereon, being positioned between foundation blocks. The foundation blocks 60 are secured to a footing by mortar or cement. They are positioned in rows atop one another and the adjacent upper block is normally staggered with respect to the two blocks below it such that the upper block sits evenly divided on the seam between the two adjacent lower blocks. In FIG. 9, lower blocks 60A and 60B are topped by an upper block 60C (Shown in cross-section). Prior to positioning block 60C, a support plate 10 would have been positioned atop block 60A such that edges 16, 18, 20 and 22 of support plate 10 would be sandwiched between block 60A and block 60C when it is positioned atop block 60A and 60B and secured by mortar or cement 61. In the preferred embodiment, support plate would have a plurality of perforations 11 proximate its peripheral edges 16, 18, 20 and 22. This would further assist in stabilizing the support plate and the resultant anchor bolt in that as mortar would be applied to the tops of blocks 60A and 60B, the mortar or cement would cover the peripheral edges of the support plate and seep into the perforations 11 further stabilizing the support plate 10 and resultant anchor bolt when construction block 60C were pressed downwardly on the overlaid mortar and cement.

Channel member or clip 24, with or without leg or rotation stops, and support plate 10 would be positioned within one of the cores 63 of upper block 60C. Assuming block 60C would be the top row of the foundation and be capped by a sill plate 67, an anchor bolt 40 would be positioned within the channel member or clip 24 and maintained in a vertical position by leg or rotation stops 48 and 50 or the equivalent thereof such that its upper threaded end 52 extends upwardly beyond core 63 of block 60C so as to enable threaded end 52 to pass through an aperture in the sill plate 67 and be secured by a nut 69.

The support plate 10 and anchor bolt 40 assembly as illustrated in FIG. 9 is secured to a sill plate 67 and is positioned below the top row of blocks 60. In the other embodiment the support plate may be positioned two levels or more below the top surface of the foundation wall. Building codes in areas where hurricanes or tornadoes are prevalent might require such a positioning. The only difference is that the long leg 46 of anchor bolt 40 would have a longer extension in order to be able to be inserted through sill plate 67 and secured by nut 69. In all other respects, the positioning of the support plate and its securing between upper and lower rows of block 60 and the positioning of the anchor bolt 40 on the support plate 10 are identical to that as described heretofore.

Therefore, while the present invention has been disclosed with respect to the preferred embodiments thereof, it will be recognized by those of ordinary skill in the art that various changes and modifications can be made without departing from the spirit and scope of the invention. It is therefore manifestly intended that the invention be limited only by the claims and the equivalence thereof.

We claim:

1. An apparatus for positioning an L-shaped anchor bolt within a construction block wall for subsequent connection to a sill plate, anchoring said sill plate for erection of frame construction from said sill plate, the apparatus comprising:

a planar base member defined by a periphery formed with an upper surface and a lower surface positioned at a predetermined location within a construction block wall intermediate a top and bottom of adjacent vertical blocks of said construction block wall; and a unitary securing means formed on said upper surface of said base member releasably securing a short leg of L-shaped said anchor bolt to said planar base member said long leg of said anchor bolt is maintained in a vertical position and at a height so as to be slidably received through an aperture formed in a sill plate positioned atop said construction block wall, said securing means comprising a clip member defining a channel, for the slidable receipt and frictional engagement of said short leg of said anchor bolt between said clip and said planar base member.

2. The apparatus for positioning an L-shaped anchor bolt within a construction block wall in accordance with claim 1 wherein said clip is unitary with said base member and is formed by a parallel die cut and punch, thereby defining said channel for slidable receipt of said short leg of said L-shaped anchor bolt.

3. The apparatus for positioning an L-shaped anchor bolt within a construction block wall in accordance with claim 1 wherein said securing means further comprises a pair of spaced apart vertical stops in parallel arrangement, and spaced apart a distance equal to a diameter of said long leg of said anchor bolt, said spaced apart stops preventing rotation of said short leg within said clip and maintaining said long leg in vertical orientation.

4. The apparatus for positioning an L-shaped anchor bolt within a construction block wall in accordance with claim 3 wherein said spaced apart stops are unitary with said base plate being partially cut and bent vertically from said base member.

5. The apparatus for positioning an L-shaped anchor bolt within a construction block wall in accordance with claim 4 wherein said stops engaging said long leg of said L-shaped anchor bolt are acutely angular with respect to said base member and cut and punched from said base member to said angular orientation.

6. The apparatus for positioning an L-shaped anchor bolt for a construction block wall in accordance with claim 4 wherein said stops are formed of opposing U-shaped cuts parallel to said clip member defining a channel, said opposing U-shaped cuts bent vertically engaging a portion of said long leg of said L-shaped anchor bolt maintaining said long leg of said anchor bolt in a vertical orientation.

7. The apparatus for positioning an L-shaped anchor bolt within a construction block wall in accordance with claim 1 wherein said clip member defining a channel is formed with a U-shaped notch along one edge, said U-shaped notch engaging said long leg of said anchor bolt maintaining said long leg of said anchor bolt in a vertical orientation.

8. The apparatus for positioning an L-shaped anchor bolt within a construction block wall in accordance with claim 1 wherein said base member is formed with a plurality of apertures about said periphery of said base member to improve adhesion of said base member between said top and bottom of said adjacent vertical blocks upon the application of mortar between said adjacent vertical blocks.

* * * * *